US007935039B2

(12) United States Patent
Dannenberg

(10) Patent No.: US 7,935,039 B2
(45) Date of Patent: May 3, 2011

(54) MUSCLE TONER EXERCISE APPARATUS

(76) Inventor: Jef Dannenberg, Fort Lauderdale, FL (US)

( * ) Notice: Subject to any disclaimer, the term of this patent is extended or adjusted under 35 U.S.C. 154(b) by 0 days.

(21) Appl. No.: 12/260,176

(22) Filed: Oct. 29, 2008

(65) Prior Publication Data

US 2009/0298656 A1 Dec. 3, 2009

Related U.S. Application Data

(60) Provisional application No. 61/057,221, filed on May 30, 2008.

(51) Int. Cl.
*A63B 71/00* (2006.01)

(52) U.S. Cl. ..... 482/141; 482/62

(58) Field of Classification Search ..... 482/141, 482/132, 62

See application file for complete search history.

(56) References Cited

U.S. PATENT DOCUMENTS

| | | | | |
|---|---|---|---|---|
| 1,824,920 | A | 9/1931 | Novak | |
| 2,821,394 | A | 1/1958 | Barbeau | |
| 3,134,590 | A | 5/1964 | Young | |
| 3,403,906 | A | 10/1968 | Burzenski | |
| 3,752,475 | A | 8/1973 | Ott | |
| 3,784,192 | A * | 1/1974 | Nutter | 482/132 |
| 3,809,393 | A * | 5/1974 | Jones | 482/132 |
| 4,134,584 | A * | 1/1979 | Rosenbusch | 482/93 |
| 4,171,805 | A | 10/1979 | Abbott | |
| 4,595,197 | A | 6/1986 | Hagstrom et al. | |
| 4,610,448 | A | 9/1986 | Hill | |
| 4,768,778 | A | 9/1988 | Thomas, Jr. | |
| 4,892,305 | A * | 1/1990 | Lynch | 482/132 |
| 5,358,463 | A * | 10/1994 | Fuentes | 482/141 |
| 5,632,707 | A * | 5/1997 | Daniel et al. | 482/8 |
| 5,643,162 | A | 7/1997 | Landers et al. | |
| 5,697,874 | A * | 12/1997 | Abelbeck | 482/140 |
| 6,186,930 | B1 | 2/2001 | Ignaczak | |
| 6,773,379 | B1 * | 8/2004 | Bing | 482/132 |
| 6,979,285 | B2 | 12/2005 | Lovison | |

(Continued)

OTHER PUBLICATIONS www.perfectpushup.com; Perfect Pushup (Registered Trademark).

*Primary Examiner* — Lori Baker
(74) *Attorney, Agent, or Firm* — Mark D. Bowen, Esq.; Malin Haley DiMaggio Bowen & Lhota, P.A.

(57) ABSTRACT

A muscle toning exercise device adaptable from a stationary configuration wherein the device is capable of 360° rotation about a vertical axis, to a movable configuration wherein the device is capable of movement in all directions on a planar surface in addition to 360° rotation. The exercise device includes a handle that extends out from a base that supports the weight of a user. The base of the exercise device contains a series of rolling members that protrude out from the bottom to allow the device to move along the surface upon which the exercise is being performed so that the entire exercise device can be rotated a full 360° about an axis that extends through the center of the device, while further allowing for the displacement of the base, and subsequently the entire exercise device in any direction along a planar surface. A separate cup-shaped base member that rests on the planar surface and in which the exercise device may be selectively installed in covering relation with the rolling members. The cup-shaped member includes a vertically projecting generally cylindrical side wall extending around the base of the exercise device thereby limiting the linear displacement of the device along the planar surface and allowing only for the rotation of the device about a central axis.

1 Claim, 3 Drawing Sheets

U.S. PATENT DOCUMENTS

| | | | | |
|---|---|---|---|---|
| 7,108,643 | B2 | 9/2006 | Wilson et al. | |
| 7,377,888 | B2 * | 5/2008 | Godbold | 482/141 |
| 7,468,025 | B2 * | 12/2008 | Hauser et al. | 482/141 |
| 2005/0209072 | A1 * | 9/2005 | Sheron | 482/132 |
| 2006/0035771 | A1 * | 2/2006 | Gant | 482/141 |
| 2007/0298947 | A1 * | 12/2007 | Eksteen | 482/141 |
| 2008/0306447 | A1 * | 12/2008 | West et al. | 604/174 |
| 2009/0318793 | A1 * | 12/2009 | Datta et al. | 600/391 |

* cited by examiner

MUSCLE TONER EXERCISE APPARATUS

CROSS REFERENCE TO RELATED APPLICATIONS

This application claims the benefit of provisional U.S. Patent Application Ser. No. 61/057,221, filed May 30, 2008.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction of the patent document or patent disclosure as it appears in the Patent and Trademark Office patent file or records, but otherwise reserves all copyrights rights whatsoever.

BACKGROUND OF THE INVENTION

1. Field of the Invention

The present invention relates generally to exercise devices, and more particularly to a muscle toning exercise device that allows for the selective linear and rotational movement of the hands and arms of the user, while performing push-up type exercises in a prone position.

2. Description of Related Art

Physical exercise has grown in popularity over the years as a means for both improving the overall health and the physical appearance of a person while also serving as a means for reducing stress. Physical exercise includes a wide array of different training methods, including strength training, one of the most popular forms of exercise. Strength training involves creating a resistance force against the natural contraction of a muscle. The resistance force that is applied against muscle contraction is generated through a variety of methods including gravity, resistance, or elastic/hydraulic forces. While strength training is generally performed to increase the strength and size of muscles, many other benefits are also achieved. Such benefits include improved posture, prevention of osteoporosis, improved cardiac function, and improved joint function.

One of the most commonly performed strength training exercises is the bench press. The bench press involves a user lying on a bench, lowering a bar with attached weights towards the chest, and pushing it back up. Through the movement of a weighted bar towards and away from the chest, gravity acts as the source of resistance force against the natural contraction of the upper torso muscles that are used in performing the exercise. The bench press exercise involves, and subsequently increases the strength and size of many muscles including the pectoralis major, the deltoids, and the triceps. While the bench press exercise provides an effective means for strength training, there are also many drawbacks to the exercise. One such drawback is the bulky and heavy equipment that is required to perform the exercise, making quick and convenient performance of the exercise difficult. Furthermore, due to the use of heavy weights, often times the presence of a "spotter" is necessary for ensuring safety. Another disadvantage is that if not executed using the proper form and technique, the bench press exercise can cause many potential injuries, including torn ligaments and tendons, back injuries, and broken ribs.

Another common strength training exercise is the push-up. In performing a push-up, a user assumes a prone position, and lifts the body using the arms. Through this exercise, the weight of the body serves as the main source of resistance to the muscles, particularly the pectoralis muscles, which are used in performing the push-up. While the push-up is less strenuous than the bench press and is limited by the weight of the body of the user performing the exercise, it is generally safer and more convenient to perform.

The prior art teaches a variety of inventions that seek to improve the overall effectiveness of the push-up as a strength training exercise by both isolating specific muscles, and increasing the resistance and subsequent difficulty in performing a push-up. U.S. Pat. No. 2,821,394 issued to Barbeau (1954) describes a push-up exercise device including spring controlled roller that is used in laterally moving each arm towards and away from the torso as the push-up exercise is performed. The spring serves to provide control of the roller as it is used, thereby avoiding potential user injury. By laterally moving each arm towards and away from the upper torso in performing a push-up, the inner regions of the pectoral muscles and the shoulders are targeted with a higher level of resistance, resulting in a more intense strength training exercise that improves strength in specific muscles and regions of muscles.

U.S. Pat. No. 3,809,393, issued to Jones (1974), and U.S. Pat. No. 4,134,584, issued to Rosenbusch (1979), both describe arm exercising devices that are hand held apparatus mounted on caster wheels. Both devices include grips and are moveable in any direction along a flat planar surface. Through the use of the described inventions in combination with a typical push-up, an increased resistance leading to the strengthening of the arms and wrist muscles is achieved. Furthermore, the caster rolling exercise devices limit the risk of potential injury to the user by not contorting the wrists and hands of the user into unnatural positions.

U.S. Pat. No. 5,643,162, issued to Landers et al. (1997), describes an exercise apparatus that includes a stationary track guide means with rollers placed inside of the track to allow for the displacement of the arms towards and away from the upper torso during the performing of a push-up. Similar to the invention disclosed in the '194 patent, the invention disclosed in the '162 patent targets specific muscles and regions within muscles in providing increased resistance. In another embodiment, the device includes a circular grip means that can be rotated within the track guide to further isolate other muscles such as the deltoids. While the described invention includes a number of various combinations for isolating and increasing the resistance of multiple muscle groups while performing push-up exercises, it is bulky and therefore not easily transportable.

U.S. Pat. No. 6,773,379, issued to Bing (2004), describes an exercise device that includes a gripping means that rotates on a base that is attached to wheels. The rotation of the gripping means handle assembly allows for the movement of the handle assembly in a specific position as desired by the user for performance of the exercise. In using wheels, once the handle assembly is positioned, the entire device displaces linearly in a direction determined by the positioning of the handle assembly. Through this exercise, a user moves the arms away from the body while in a prone position, thereby isolating specific muscles. One disadvantage of this invention is that the wheels displace linearly, thereby limiting the range of motion by which the device is displaced. Another disadvantage of this invention is that the handle assembly is not designed for rotation within the base of the device during performance of the exercise, thereby excluding the targeting of many muscles of the upper torso.

A product now available on the market called the PERFECT PUSHUP® at www.perfectpushup.com utilizes a handle assembly that swivels within a base as the push-up is being performed. The base remains stationary on the flat surface so that the only movement of the device is the swiveling of the handle assembly within the stationary base. Through this device, the traditional push-up is modified to increase the resistance as the exercise is performed. Furthermore, the device serves to target specific muscles, such as the deltoids, by increasing the resistance to the natural contraction movement of the target muscles while the exercise is being performed. The main disadvantage with this device is that the base does not move along the flat surface, thereby not allowing for the displacement of the arms towards and away from the upper torso so that many of the muscles that are used in performing a push-up are not targeted with an increase in resistance.

There therefore exists a need for an exercise device that specifically targets a variety of muscles within the upper torso and increases resistance while performing a push-up type exercise. Such a device must allow for the continuous swiveling of a gripping handle assembly within a base, which can be displaced in any direction on a planar surface. Furthermore, the device must include a means for stopping the displacement of the base on a flat surface, so that only the swiveling rotating motion of the device occurs. Finally, the device must be compact and portable, allowing for use in a convenient location on any flat surface.

BRIEF SUMMARY OF THE INVENTION

The present invention overcomes the limitations and disadvantages present in the art by providing a muscle toning exercise device adaptable from a stationary configuration wherein the device is capable of 360° rotation about a vertical axis, to a movable configuration wherein the device is capable of movement in all directions on a planar surface in addition to 360° rotation. The device is meant for operation during the performance of push-up exercises in a prone position and allows a user to target and increase the resistance experienced by a variety of different muscles that are used in executing a push-up. The exercise device includes a handle that extends out from a base that supports the weight of a user. Through the use of a handle, a means of engaging the exercise device while performing a push-up type exercise is provided.

The base of the exercise device contains a series of rolling members, such as ball bearing caster type wheels that protrude out from the bottom of the. The rolling members move along the surface upon which the exercise is being performed so that the entire exercise device can be rotated a full 360° about an axis that extends through the center of the device. Furthermore, the rolling members allow for the displacement of the base along a flat surface, and subsequently the entire exercise device in any direction along a planar surface. The exercise device includes a separate cup shaped stationary member that rests on the planar surface and in which the exercise device may be placed. The cup-shaped member includes a vertically projecting generally cylindrical side wall extending around the base of the exercise device thereby limiting the linear displacement of the device along the planar surface and allowing only for the rotation of the device about a central axis.

Accordingly, it is an object of the present invention to provide an exercise device that targets specific muscles and increases the resistance experienced by such muscles while performing a push-up type exercise.

It is another object of the present invention to provide an exercise device that targets specific muscles and increases the resistance experienced by such muscles while performing a push-up type exercise by allowing for the linear displacement of the device in any direction along a planar surface.

It is yet another object of the present invention to provide an exercise device that targets specific muscles and increases the resistance experienced by such muscles while performing a push-up type exercise by allowing for the rotation of the device about an axis that extends through the center of the exercise device.

It is still another object of the present invention to provide an exercise device that targets specific muscles and increases the resistance of such muscles while performing a push-up type exercise by both allowing for the linear displacement in any direction along a planar surface and the complete rotation about a central axis of the exercise device.

It is furthermore another object of the present invention to provide an exercise device that targets specific muscles and increases the resistance of such muscles while performing a push-up type exercise that is both compact and transportable.

It is another object of the present invention to provide an exercise device that targets specific muscles and increases the resistance of such muscles while performing a push-up type exercise that is manufactured inexpensively.

In accordance with these and other objects, which will become apparent hereinafter, the instant invention will now be described with particular reference to the accompanying drawings.

DETAILED DESCRIPTION OF THE INVENTION

Figure 1:
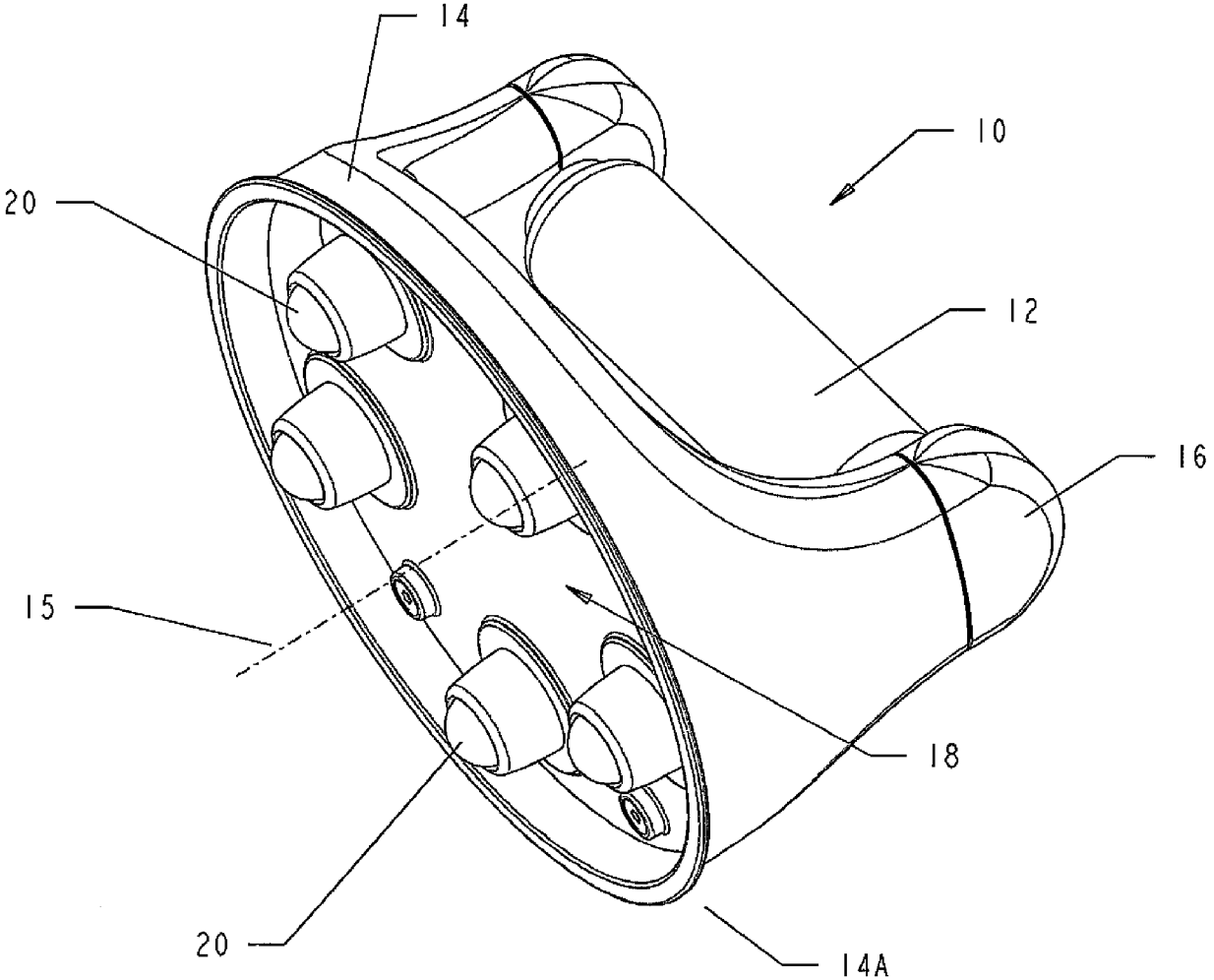
FIG. 1 is a bottom perspective view of an exercise device in accordance with a preferred embodiment of the present invention.
Figure 2:
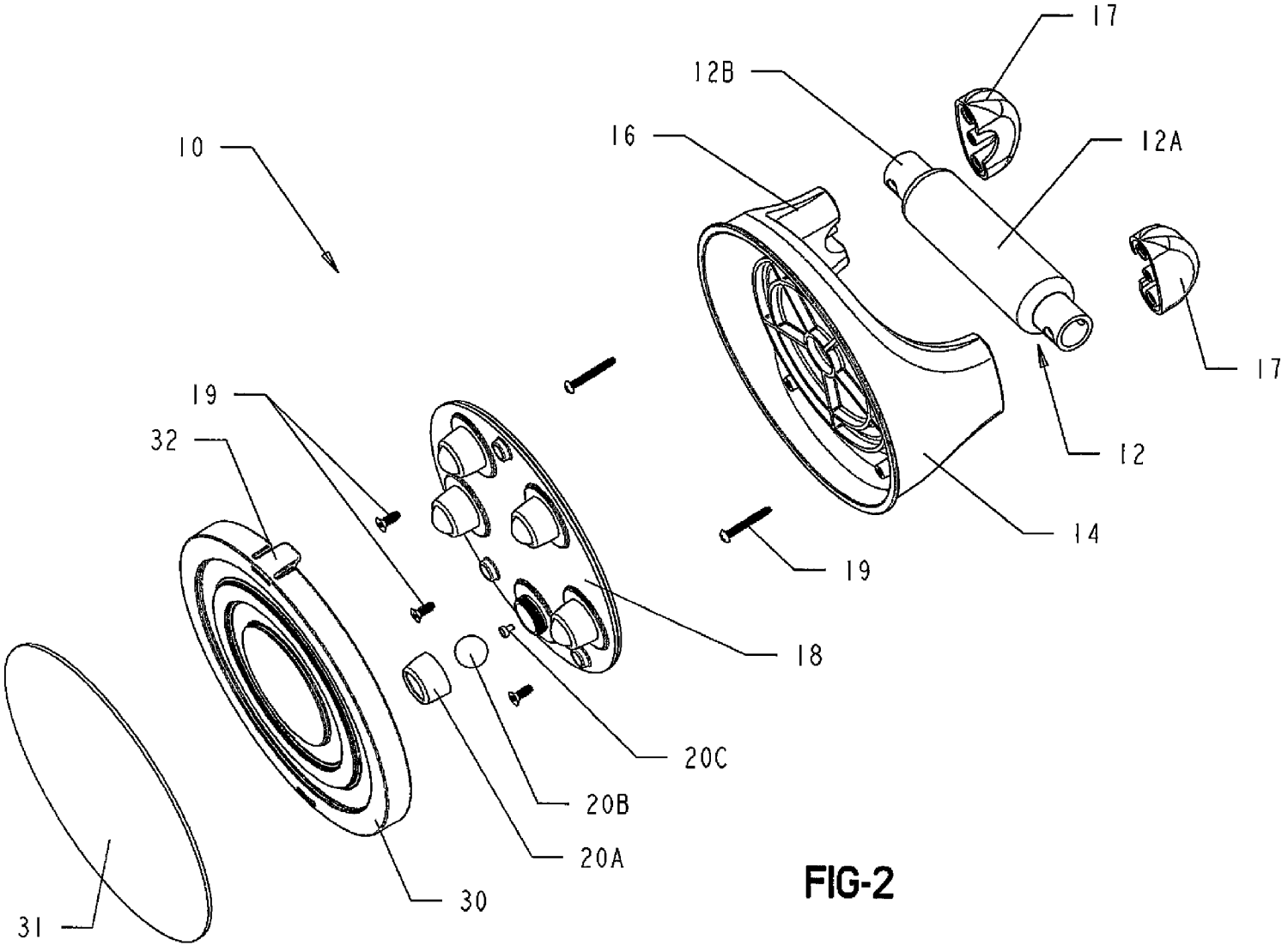
FIG. 2 is an exploded perspective view of the exercise device with the separate stationary cup shaped member for limiting the linear movement of the exercise device along a planar surface.
Figure 3:
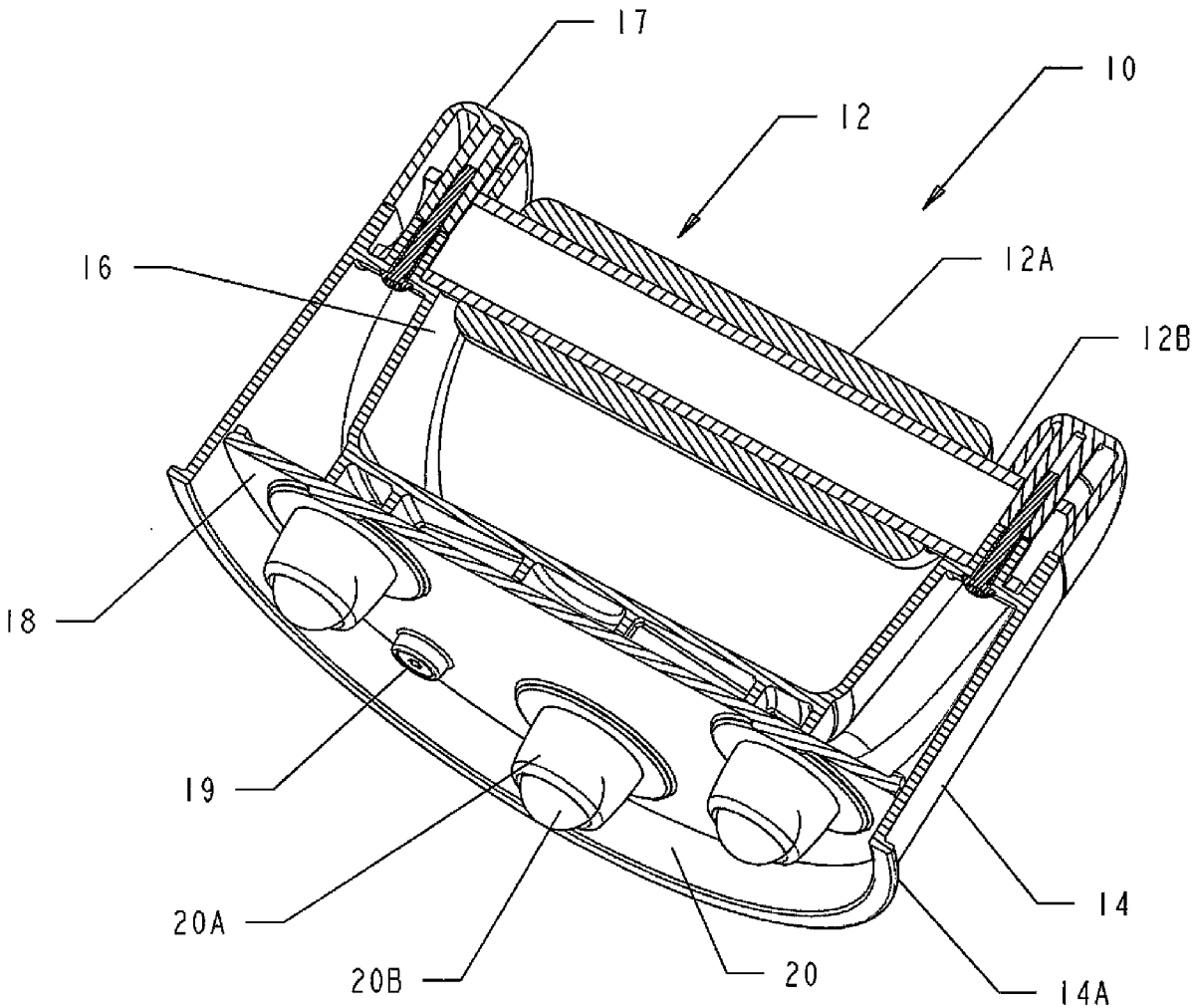
FIG. 3 shows a cross sectional view of the exercise device.

With reference now to the drawings, FIGS. 1-3 depict a muscle toning exercise device 10 in accordance with the present invention. Exercise device 10 includes a handle 12 that is positioned on top of a base 14. Handle 12 is supported above base 14 by two handle support members 16 that protrude monolithically out from the top of base 14. Support members 16 preferably extend out from opposing tangential points of the outer circumference of base 14, so that handle 12 stretches substantially across the entire diameter of base 14. Handle support members 16 are coupled to opposing ends of handle 12 through a stationary dowel like assembly. Base 14 is preferably circular shaped so that as the device is rotated about an axis 15 that extends through the center of base 14, the curvature of the outer surface of the base 14 remains constant. In a preferred embodiment, handle 12, base 14, and handle support members 16 are constructed from a rigid material that is capable of filly supporting the weight of various users.

A plate 18 fits into a recess in the bottom of base 14. Plate 18 has a plurality of rolling members, generally referenced as 20, fixed thereto and projecting therefrom. In a preferred embodiment, rolling members 20 comprise ball bearing type casters that function to provide smooth and quiet rolling motion. The use of a plurality of ball bearing casters allows for the rotational swivel movement and linear displacement of the exercise device 10 on top of a planar surface. As best illustrated in FIG. 1, a plurality of ball bearing type casters are concentrically positioned in an inner circle around an axis 15 that extends through the center of the base 14. Through the concentric positioning of the ball bearing type caster rolling members 20 relative to the periphery of base 14, the exercise device can rotate completely about the central axis 15 without plate 18 or the bottom peripheral edge of base 14 making contact with the surface upon which this rotation movement occurs. Furthermore, this concentric positioning combined with the rotation of the ball bearing within the ball bearing type caster rolling member allows for the unhindered movement of the push-up type exercise device 10 in any direction.

FIG. 2 shows an exploded perspective view of the push-up type exercise device 10 with a stationary cup-shaped cover 30 that functions to selectively prevent lateral motion, and FIG. 3 shows a non-exploded sectional view thereof. The stationary cup-shaped cover 30 is in the same circular shape as the exercise device 10 and particularly base 14, and, when installed rests on the planar surface upon which the push-up type exercise is performed. Cup-shaped cover 30 is preferably adapted with resilient prongs 32 that function to engage a radially projecting annular peripheral lip 14A formed on base 14 by removable connection, such as a snap fit. The annular peripheral lip 14A and snap fit engagement allows cup-shaped cover 30 to rotate relative to base 14 about axis 15, while preventing the linear rolling motion across the underlying surface that the device is capable of without the cup-shaped cover 30 attached. In limiting the linear movement of the exercise device 10 while still allowing for rotational movement, the exercise device 10 is adjusted to specifically target, and subsequently increase the resistance to the muscles used in performing a push-up type exercise in combination with rotating handles. Stationary cup-shaped cover 30 provides a simple and effective means for changing the configuration of the exercise device 10 in a quick manner, thereby allowing the user to perform various modified forms of the general push-up exercise. Furthermore, cover 30 eliminates the need for bulky support tracks and structures, making the exercise device completely portable. Cover 30 preferably includes a non-slip bottom surface 31 to prevent unwanted movement during use. Bottom surface 31 may comprise any suitable resilient surface such as rubber, neoprene, or any other suitable non-slip material.

Muscle toning exercise device 10 contains a handle 12 that is used as the means through which the user engages and operates the exercise device. Handle 12 consists of a central generally cylindrical shaped gripping section 12A, and two smaller cylindrical shaped dowel support members 12B that extend out from opposing ends of the main gripping section 12A. Gripping section 12A preferably includes a padded sleeve for comfort. Dowel support members 12B rest in two semicircular channels that are located on the end of two opposing handle support members 16. Handle support members 16, as mentioned previously, protrude upward from opposing ends of the top surface of a base 14, such that a monolithic piece is formed. A capping piece 17 is coupled to the top of each opposing handle support member 16. Capping piece 17 has a semi-circular groove or concave portion that, upon coupling to the handle support member 16, completes the circular channel in which the dowel support members 12B are fixedly disposed. Handle 12 in combination with the handle support members 16 and the capping pieces 17 form a stationary dowel support assembly that function to transfer the force created by the weight of the user propped up in a prone position, down through the handle and into base 14 of the exercise device. Furthermore, the stationary dowel support assembly, and in particular the handle 12 provide a means for controlling the linear displacement and rotational movement of the exercise device 10 in performing push-up type exercises from the prone position.

Base member 14 is generally cylindrically-shaped and hollow with a cavity opening on the bottom side thereof. As noted above, a plate 18 is sized and shaped for inserted installation within the cavity formed in base member 14 and is preferably secured by fasteners 19. Plate 18 serves to create a flat surface, within the cavity of the base member, upon which rolling members 20 are mounted and supported. Rolling members 20 are preferably mounted in the previously mentioned concentric configuration on plate 18 through any suitable means, including but not limited to screws, bolts, mechanical fit, heat or sonic welding, or adhesive. As noted above, rolling members 20 preferably comprise ball bearing type casters and include spherical ball bearing 20B contained within a cylindrical housing 20A and supported by a bearing member 20C having a concave bearing surface. The spherical ball bearing 20B rotates in any direction within the cylindrical housing 20A, thereby allowing for an unlimited range of movement along a specific plane.

Cylindrical housing component 20A is connected to plate 18 such that spherical ball bearing 20B protrudes beyond the lower peripheral edge of base 14. By extending completely out from the bottom surface plate 18 aperture, the spherical ball bearing 20B makes continuous contact with the planar surface upon which the exercise device 10 is placed on and ensures that the bottom of surface plate 18 does not make contact with the planar surface upon which the movement of the exercise device occurs. This, in turn, allows for the continuous and unhindered linear displacement and rotational swiveling movement of the exercise device 10.

Push-up type exercises are performed in combination with the present invention by using two of the devices described herein. The user grasps each device by wrapping his left and right hands about the handle 12 of each of the two exercise devices so that a secure grip is created. Then, the user assumes a prone position, with either the feet or the knees making contact with the ground. Once the user is in a prone position, a number of different exercises exist for use in combination with the present invention. In one exercise, the arms of the user remain unbent while the user displaces the exercise device along any linear direction on the planar surface. In displacing the exercise device and subsequently the hands and arms of the user, the body of the user lowers towards the ground. The user then uses the targeted muscles to lift the body without bending the arms, thereby completing the modified push-up type exercise.

In another exercise, the user places two exercise devices 10 into the stationary cup-shaped covers 30, and subsequently assumes a prone position, with the hands of the user coupled to and wrapped around the handles of the two exercise devices of the present invention. As the linear displacement of the exercise device of the present invention is eliminated by the installation of cup-shaped covers, the user must bend the arms in the same manner as performing a push-up in order to lower their body toward the ground. As the body is lowered, and the arms of the user are bent, the exercise devices 10 and subsequently the hands and arms of the user may rotate each device 10 within the associated cup-shaped cover 30. In turn as the user lifts their body away from the ground, the exercise devices and subsequently the hands and arms of the user are rotated in a direction opposite the rotation achieved through the lowering of the user's body. By causing the rotation of the hands and arms, about axis 15, while performing a push-up type exercise, the exercise device of the present invention allows for the targeting and subsequent increase in resistance experienced by a variety of muscles in performing a push-up type exercise. Furthermore, by elevating the hands away from the surface upon which the push-up is performed, the user can lower the body further down, creating a greater range of motion. Finally, the handle configuration of the present invention reduces the stress upon the wrists that a user experiences during the performing of a standard push-up.

In another push-up type allowed for by the device of the present invention, the two previously mentioned exercises are combined, so that a user sits in a prone position gripping one exercise device of the present invention in each hand. The exercise devices are placed directly on the surface upon which the exercise is being performed on. The user keeps the arms in a non bent position and lowers his or her body towards the ground by displacing the arms away from the body. As the arms are displaced away from the body in a roughly linear manner, the exercise devices of the present invention are each individually rotated in either a clock wise or counter clock wise direction about an axis extending through the center of the device. Once the body is lowered completely, the user then moves the exercise devices and subsequently gripping hands back towards the body as the arms continuously remain in a non bent position. As the arms and hands are moved back towards the body, causing the body to lift away from the surface upon which the exercise is performed, the individual exercise devices, and subsequent hands and arms of the user are rotated in a direction opposite of the direction of individual rotation achieved as the body was lowered. Through this exercise, the benefits of both previously mentioned exercises are achieved, including the targeting of all muscles specifically targeted individually by each exercise.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An exercise apparatus for use on a supporting surface, said apparatus comprising:

a main body having a generally circular bottom having a radially projecting lip, a top, and a handle connected to said main body and disposed in generally spaced relation with said top, said handle generally intersecting a vertical center axis projecting upward from said main body;

at least one roller projecting from the bottom of said main body to enable the main body to both roll over the supporting surface and pivot about said vertical axis;

a cover removably attachable in covering relation with said at least one roller, said cover having an upwardly projecting generally cylindrical wall, said wall including a pair of diametrically opposed resilient prongs adapted for engaging said radially projecting lip;

said cover manually configurable between an attached configuration wherein said cover is secured to said radially projecting lip and wherein said apparatus is restricted to rotational movement relative to said cover, and a detached configuration wherein said cover is separated from said apparatus and said apparatus is able to roll freely over the supporting surface.

* * * * *